US005737902A

United States Patent [19]

Aylward

[11] Patent Number: 5,737,902

[45] Date of Patent: Apr. 14, 1998

[54] APPARATUS AND METHOD FOR PACKAGING PILLS

[75] Inventor: John T. Aylward, New Bern, N.C.

[73] Assignee: Aylward Enterprises, Inc., New Bern, N.C.

[21] Appl. No.: 715,872

[22] Filed: Sep. 19, 1996

[51] Int. Cl.[6] ..... B65B 5/10; B65B 35/32; B65B 35/56

[52] U.S. Cl. ..... 53/475; 53/245; 53/246; 53/260; 53/535; 53/539; 53/900

[58] Field of Search ..... 53/475, 473, 448, 53/446, 443, 246, 260, 539, 534, 559, 900, 535, 244, 245, 255

[56] References Cited

U.S. PATENT DOCUMENTS

| | | | |
|---|---|---|---|
| 3,775,941 | 12/1973 | Bross | 53/246 |
| 3,808,772 | 5/1974 | Turtschan | 53/141 |
| 4,233,801 | 11/1980 | Watt | 53/559 X |
| 4,685,271 | 8/1987 | Ringer et al. | 53/246 |
| 4,693,057 | 9/1987 | Rittinger et al. | 53/539 |
| 4,800,705 | 1/1989 | Bodolay | 53/168 |
| 4,897,985 | 2/1990 | Buchko et al. | 53/559 |
| 4,938,001 | 7/1990 | Vico | 53/559 X |
| 4,999,979 | 3/1991 | Vicq | 53/559 |
| 5,329,749 | 7/1994 | Yamamoto et al. | 53/246 X |

OTHER PUBLICATIONS

Brochure of Aylward Enterprises, Inc., 1992.

*Primary Examiner*—James F. Coan

*Attorney, Agent, or Firm*—Bell Seltzer Intellectual Property Law Group of Alston & Bird, LLP

[57] ABSTRACT

A packaging apparatus is provided for placing pills into a series of pill receptacles moved under the apparatus at a predetermined speed by a conveyor. The packaging apparatus includes an escapement mechanism positioned above at least one drop chute and a vertical positioner for moving the drop chute adjacent to the pill receptacles so that pills may be sequentially placed into the pill receptacles. The apparatus includes a first horizontal positioner for moving the drop chute in a horizontal direction parallel to the path of travel of the pill receptacles and at a speed independent of the speed of the pill receptacles so that the lower end of the drop chute can be moved horizontally with respect to a pill receptacle while a pill is being placed therein. The apparatus may also further include a second horizontal positioner for moving the drop chute in horizontal directions transverse to the path of travel. In another aspect, the invention includes a tray for passing pills through openings therein into the escapement mechanism. The tray is moved up and down by an actuator which is capable of reciprocating at a rate independent of the position of the tray to ensure that several pills do not become interlocked and block the openings. Associated methods also form a part of the present invention.

37 Claims, 7 Drawing Sheets

APPARATUS AND METHOD FOR PACKAGING PILLS

FIELD OF THE INVENTION

The present invention relates to apparatus and methods for packaging, and more particularly relates to apparatus and methods for packaging pills, tablets, capsules and the like.

BACKGROUND OF THE INVENTION

Pharmaceutical products such as pills, tablets, capsules and the like are often packaged in disposable packaging before being shipped to the consumers. Such disposable packaging includes thermoformed and cold formed blister packages as well as pouches, sachets or disposable bottles.

Conventional blister packages typically include a generally planar web portion having a multitude of depressions formed therein. The depressions can be formed by thermoforming if the web is made of a thermoplastic material, or by cold forming if the web portion is formed of a ductile material such as aluminum. Each of the depressions forms a receptacle for one pill and may be arranged in a grid fashion having multiple rows and/or columns. A pill is placed in each of the receptacles and then an aluminum or plastic foil layer is adhered to the planar web portion to seal an individual pill within each of the receptacles.

An important aspect of forming these packages relates to the placement of the pills in the receptacles prior to the foil layer being applied. This procedure is preferably performed by an automated machine capable of precisely and accurately placing the pills at a high rate of speed. An exemplary form of such an apparatus has been commercially available under the name Aylward Feed System from Aylward® Enterprises, Inc., New Bern, N.C., which is the assignee of the present invention. The Aylward Feed System includes a feeder cassette and drop chute assembly having multiple chutes for guiding individual pills into the appropriate receptacle. An orienting tray is positioned above the feeder cassette for passing pills into the feeder cassette, which in turn passes the pills into the drop chutes.

The orienting plate, the feeder cassette and the drop chute assembly are mounted on a frame which extends over a conveyor having a series of empty pill packages placed thereon. The frame is movable up and down in registration with the pill packages moving thereunder. The frame is fixed in the horizontal direction of the conveyor if the conveyor is an intermittent type, and is moved on a servo-driven undercarriage at the same speed as the conveyor if the conveyor is a continuous type. Thus, with continuous conveyors, the frame "gallops" back to register and move with the next empty blister package after the preceding package has been filled.

Accordingly, as an empty pill package is moved under the drop chute, the drop chute is lowered and an escapement mechanism is activated in the feeder cassette to release a single pill which falls through the drop chute and into the package. For example, with blister packages, the drop chute is lowered and a pill is released to fall through the drop chute until it engages the bottom of the blister. The frame is then raised which raises the drop chute and deposits the pill in the blister.

The drop chute may include a plurality of individual chutes arranged in a block so as to define a grid. Each of the chutes extends in a generally vertical direction, but may include a portion at the lower end thereof which is angled so that a pill exiting the drop chute does so at an acute angle relative to the blister package.

Although this type of feeder has achieved widespread commercial acceptance, problems may arise if the angle between the lower end of the drop chute and the blister package is too shallow because the chute may fail to properly release the pill. For example, a pill will often be placed into a blister receptacle by sliding the pill down the drop chute until the leading edge thereof engages a sidewall of the blister receptacle. The trailing edge of the pill, however, may still be engaged by the lower end of the drop chute. If the drop chute is immediately raised upwards to begin a new cycle, the pill may disadvantageously "stand up" on its leading edge as a result of the withdrawal of the drop chute. As would be appreciated, this phenomenon can have an adverse effect on the subsequent application of the foil layer if the trailing edge of the pill extends above the blister package.

In other cases, pills of some shapes or densities can be prone to bounce out of the individual blister receptacles after being released from the drop chutes. These and similar problems can become more frequent as the rate of blister package manufacturing is increased. Thus, there is a need for a packaging apparatus which is capable of quickly and accurately placing pills into pill receptacles without causing the pills to stand up in or bounce out of the receptacles.

The orienting tray is mounted over the feeder cassette for orienting the pills before they are passed into the drop chute. The tray has an open configuration into which a plurality of pills may be deposited and the bottom of the tray is provided with one or more openings, each of which is aligned with a drop chute. To aid the pills in advancing through the openings in the tray, the tray is given an up and down motion by way of a motor driven cam, which may have adjustable speeds. This action typically is sufficient to cause the pills to continue to feed into the drop chutes. However, even with the cyclic up and down motion imparted by the cam, it is possible for several pills adjacent to an opening to become interlocked together which blocks additional pills from reaching the opening. Such blockages can have deleterious effects by creating packages which are not fully filled with pills.

Thus, there is a need for an improved packaging apparatus for placing pills and the like into pill receptacles such as blister packages. Such an apparatus should be able to quickly and accurately position the pills within the receptacles to increase packaging speed and quality. Such an apparatus should not suffer from the disadvantages associated with conventional systems and should be able to reliably place pills into receptacles in a desired orientation before application of a foil layer. There is also a need for a packaging apparatus having an orienting tray which will not become blocked by virtue of the interlocking action of pills within the tray. Preferably, these advantages would be accomplished by a single apparatus.

SUMMARY OF THE INVENTION

The above and other objects and advantages are met by the present invention which includes a drop chute which is movable in a vertical direction and in horizontal directions both parallel and transverse to a moving series of pill receptacles. One particularly advantageous embodiment includes a horizontal positioner for moving the drop chute parallel to the pill receptacles at forward or backward speeds independent of the speed of the pill receptacles. This allows a pill to be accurately placed in a pill receptacle even while the pill receptacle is moving, and the drop chute can thereafter be removed from adjacent to the pill receptacle in the direction opposite to that of the pill receptacle so that the drop chute does not interfere with the placement of the pill. Because the horizontal speed of the drop chute is preferably precisely controlled with the apparatus of the invention, pills of a wide variety of shapes, sizes and constructions can be accurately and reliably placed into blister receptacles regardless of the speed of the blister package manufacturing process.

The packaging apparatus according to the present invention includes a base frame and a conveyor for conveying a series of pill receptacles adjacent to the base frame. The conveyor moves the pill receptacles at a predetermined average speed along a predetermined path of travel, and may operate intermittently or continuously.

The apparatus further includes at least one drop chute extending over the conveyor. The drop chute includes an upper end for receiving pills which are to be packaged and a lower end from which pills are sequentially placed into the pill receptacles. The apparatus advantageously includes a multitude of drop chutes extending in substantially parallel directions so that the lower ends of the drop chutes are arranged in a grid and a plurality of pills may be simultaneously placed into a plurality of pill receptacles.

A vertical positioner is operatively connected to the base frame and the drop chute for vertically positioning the drop chute and for moving the lower end of the drop chute adjacent to the pill receptacles. The apparatus includes a pair of arms for supporting the drop chute which are slidably supported on the base frame for moving in a vertical direction. The vertical positioner preferably includes a motor operatively connected to the base frame, an eccentric cam attached to the motor and a cam follower extending horizontally from the arms and engaging the cam. Accordingly, as the motor is operated, the cam follower follows the eccentric cam and the arms and the drop chute thereon are raised and lowered.

The packaging apparatus according to the present invention advantageously includes a first horizontal positioner operatively connected to the drop chute for positioning the drop chute relative to the base frame along a horizontal direction parallel to the path of travel of the pill receptacles. The horizontal positioner is connected to a programmable controller and moves the drop chute at a speed independent of the speed of the pill packages so that the lower end of the drop chute can be moved horizontally with respect to a pill receptacle while a pill is being placed in the pill receptacle, even if the pill receptacle is also moving. Accordingly, after a pill has dropped through the drop chute and is engaged between the lower end of the drop chute and the receptacle, the drop chute may be withdrawn therefrom with a horizontal component to its motion. The horizontal movement is independent of the speed of the pill receptacle, and in one embodiment is preferably in the opposite direction to the direction of travel of the receptacle. Accordingly, the pill will be properly placed in the receptacle and will not stand up when the lower end of the drop chute is raised to begin a new cycle. Various motions can be programmed into the controller to allow pills to be placed in the pill receptacles in any of numerous and diverse ways, thus providing great manufacturing flexibility when packaging different pills or when using different packages.

Preferably, the packaging apparatus includes a frame subassembly slidably mounted on the base frame for movement in a horizontal direction parallel to the path of travel and for supporting the drop chute. The horizontal positioner preferably further includes a motor, a threaded nut driven by the motor and a threaded shaft extending through the nut. Either the nut or the shaft is connected to the base frame and the other is connected to the frame subassembly. Accordingly, as the motor is operated, the nut or shaft which is connected to the frame subassembly is advanced relative to the base frame and the drop chute is moved in a horizontal direction parallel to the path of travel of the pill receptacles.

According to another aspect of the present invention, the packaging apparatus can also include a second horizontal positioner operatively connected to the base frame for positioning and moving the drop chute in a horizontal direction transverse to the predetermined path of travel of the pill receptacles. The second horizontal positioner includes a motor, a threaded nut and a threaded shaft extending through the nut and driven by the motor. Either the nut or the shaft is supported on a slidable frame subassembly and the other is connected to the arms.

In particular, the packaging apparatus may include both the first and second horizontal positioners for positioning and moving the drop chute in any horizontal direction. Such an apparatus includes a lower frame subassembly slidably mounted on the base frame for movement in a horizontal direction parallel to the path of travel of the pill receptacles and an upper frame subassembly slidably connected to the lower frame subassembly for movement in a horizontal direction transverse to the path of travel.

In another aspect, the present invention provides a packaging apparatus for passing a series of pills into at least one drop chute for placement of the pills into pill receptacles. The apparatus includes a tray for supporting an accumulation of pills over the drop chute. The tray has at least one opening in a lower portion thereof which is aligned with a corresponding opening in the upper end of the drop chute.

At least one controllable actuator reciprocally raises and lowers the tray and causes the pills to fall sequentially through the opening in the tray. The controller also controls the actuator to advantageously raise and lower the tray at rates of acceleration and deceleration independent of the vertical position of the tray. This variable acceleration can provide widely varied complex and simple, cyclic and noncyclic reciprocating motions to the tray and prevent the pills from forming blockages over the openings in the tray.

The apparatus includes a frame supporting the drop chute, a pair of vertically movable arms supported on the frame and at least one support member on each of the arms for supporting the tray. A first actuator moves the arms relative to the frame and the second actuator moves the support members relative to the arms. Each of the actuators preferably includes one or more air cylinders.

Associated methods also form a part of the present invention and include a method of placing pills into a series of pill receptacles moving at a predetermined speed along a predetermined path of travel. The method includes the steps of arranging a plurality of pills above an upper end of at least one drop chute; positioning the drop chute so that the lower end thereof is adjacent to the pill receptacles; and releasing one of the pills to drop through the drop chute.

The method further includes the step of moving the drop chute in a horizontal direction parallel to the path of travel of the pills and at a speed independent of the speed of the pill receptacles so that the lower end of the drop chute can be moved horizontally with respect to a pill receptacle while a pill is being placed therein. In particular, this latter step may include moving the drop chute in a horizontal direction opposite to the moving direction of the pill packages. The method may also include the step of raising the drop chute while simultaneously moving the drop chute in a horizontal direction.

A method is also provided for placing pills into a pill package having a generally planar web portion and defining a plurality of pill receptacles formed below the web portion. The method includes the steps of arranging a plurality of pills above an upper end of at least one drop chute; lowering the drop chute so that the lower end thereof is adjacent to the web portion; and releasing one of the pills to drop through the drop chute and contact the web portion so that the pill is engaged between the lower end of the drop chute and the web portion. A further step includes moving the drop chute in a horizontal direction with respect to the pill receptacles so that the pill falls into a respective pill receptacle as it is disengaged from the lower end of the drop chute.

The present invention thus advantageously provides a packaging apparatus which meets the needs felt in the art discussed above. In particular, the lower end of the drop chute can be moved with respect to the pill receptacles whether or not the pill receptacles are moving, so that a pill can be accurately placed in a pill receptacle and a wide variety of pill placement options can be achieved. For example, after a pill has been partially placed into the receptacle, the drop chute may be removed in a direction opposite to (or in a wide variety of other directions different from) the direction in which the pill was initially placed so that the lower end of the drop chute will not engage the pill (so as to misalign it) when the drop chute is vertically removed to begin a new cycle. The present invention also allows faster operating speeds because the pill placement motion can be varied to overcome high speed pill placement difficulties inherent in conventional apparatus. In addition, the present invention provides at least one controllable actuator which can raise and lower the orienting tray at rates independent of the vertical position of the tray, which is preferred in preventing blockages of pills over the openings in the tray. Thus, the present packaging apparatus provides great advantages over the conventional packaging apparatus of the art.

BRIEF DESCRIPTION OF THE DRAWINGS

In the drawings which form a portion of the original disclosure of the invention, and which are not necessarily drawn to scale.

DETAILED DESCRIPTION OF THE PREFERRED EMBODIMENTS

Figure 1:
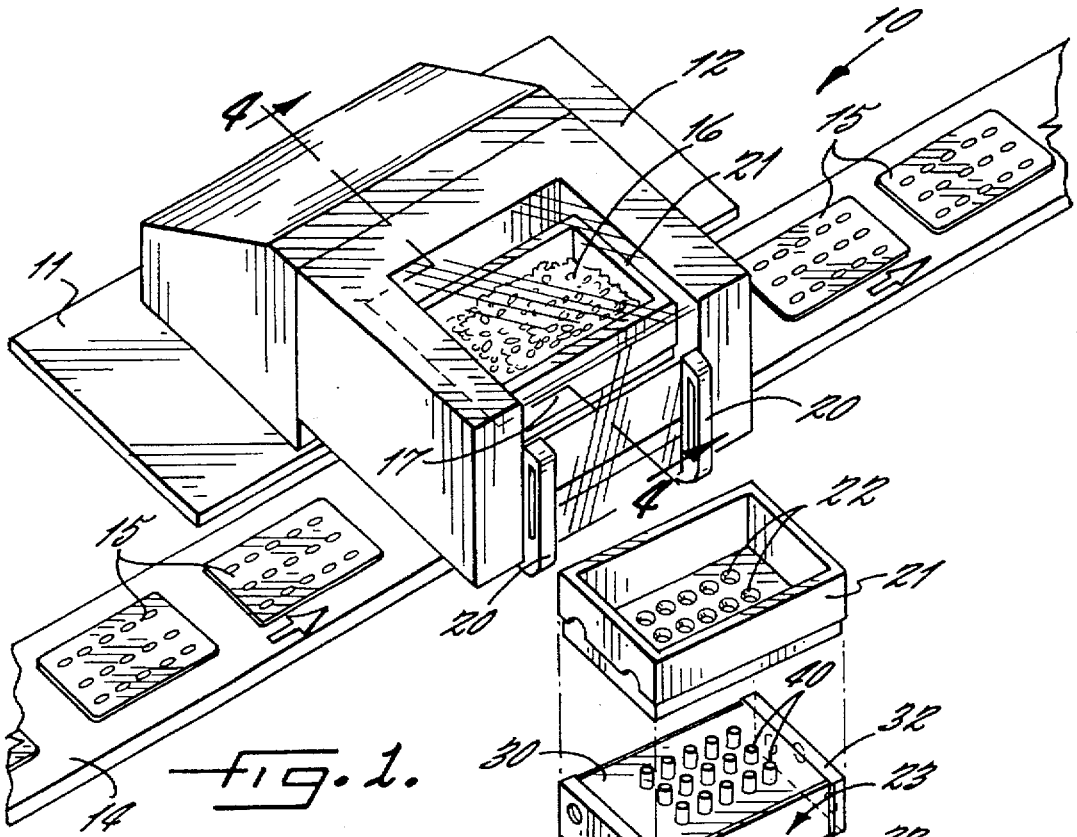
FIG. 1 is a perspective view of a packaging apparatus according to the present invention.

The packaging apparatus 10 according to the present invention is illustrated in FIG. 1. The apparatus 10 includes a base frame 11 having a base plate 12 with a substantially flat upper surface. The base plate 12 is preferably formed of a material having a low surface roughness and high cleanability such as stainless steel.

The packaging apparatus 10 includes a housing 13 which encloses most of the moving parts of the apparatus and which may also be formed of stainless steel. The housing 13 at least partially extends over a conveyor 14. The conveyor 14 can be any type of conveyor which moves a series of empty pill packages 15 in a predetermined path of travel adjacent to the packaging apparatus 10. The conveyor 14 may operate intermittently or continuously. In particular, the conveyor 14 moves the packages 15 under the housing 13 at a predetermined average speed for filling pill receptacles 18 in the packages with pills 16.

As used herein, the term "pill" is intended to include all types of small discrete products of the type which may be used in the pharmaceutical industry, including pills, tablets, capsules, caplets, and soft gel caplets or the like. Similarly, the packages are illustrated as blister packages having blisters which may be formed by thermoforming if the packages are made from a thermoplastic material, or which may be cold formed if the packages are formed from a ductile material such as aluminum. It will be understood, however, that the present invention is not limited to placing pills into blister packages, but indeed may be used for placing pills into a variety of different pill receptacles, including bottles, pouches, sachets and the like. In addition, it will be understood that the present invention is not limited to placing pills into disposable pill packages, but may also be used for placing pills into reusable holders so that the pills may then be transferred to other operations, such as a pill placement device for moving the pills from the holder into a disposable package.

The packaging apparatus 10 may also include a removable cover 17 for shielding the pills from any possible contamination. The removable cover 17 is transparent and includes a pair of handles 20 to aid in removal of the cover from the apparatus.

Figure 2:
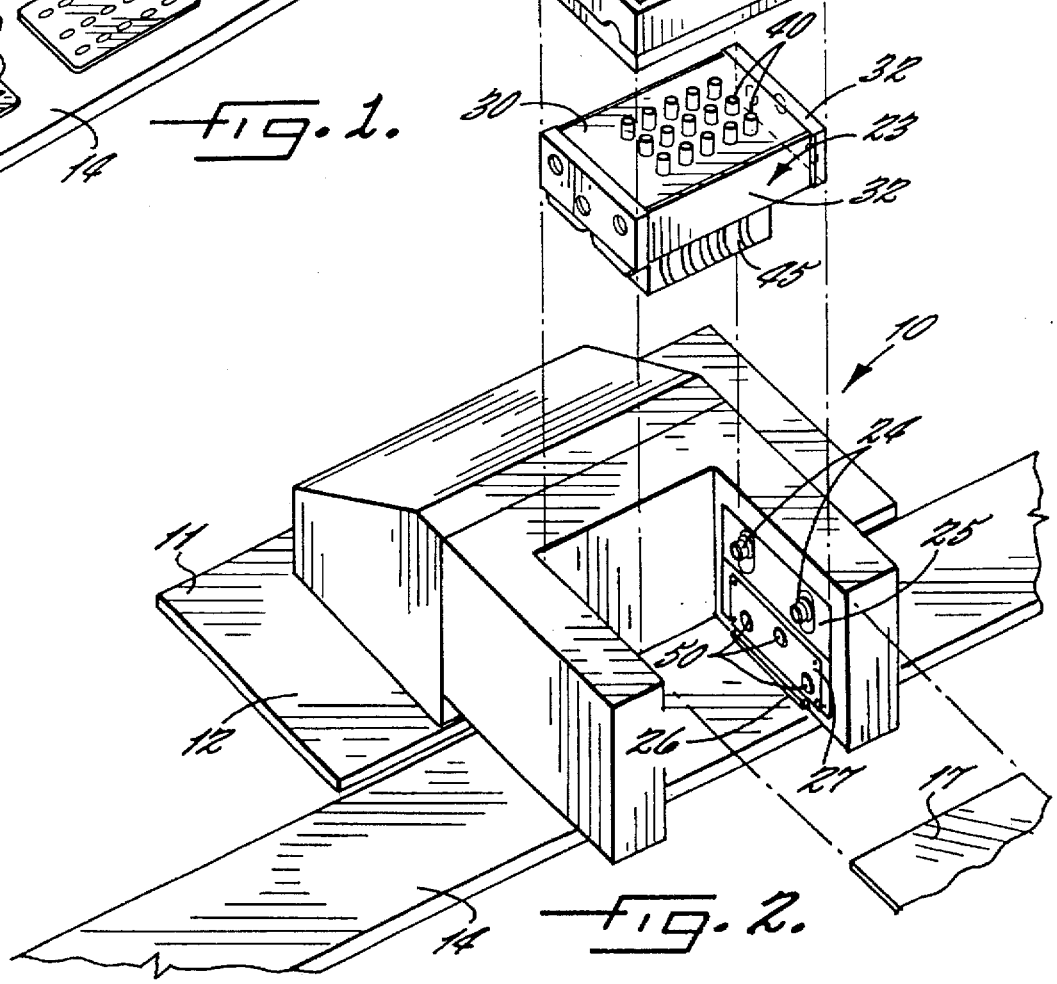
FIG. 2 is a partially exploded view of FIG. 1 illustrating a tray for supporting an accumulation of pills and a drop chute assembly for sequentially releasing those pills.

The packaging apparatus 10 is shown in a partially exploded configuration in FIG. 2 with the cover 17 removed. The packaging apparatus 10 includes a tray 21 for supporting an accumulation of pills, which accumulation can be seen in FIG. 1. The tray 21 includes a plurality of openings 22 in the lower portion of the tray which allow the pills 16 to pass therethrough. From the tray 21, the pills fall into a drop chute assembly 23, the operation of which is discussed in more detail below. The tray 21 is supported on support members, such as lugs 24, which are in turn supported on a pair of upper arms 25. The drop chute assembly 23 is supported on a pair of opposed rails 26 which are supported on the lower arms 27.

Figure 3:
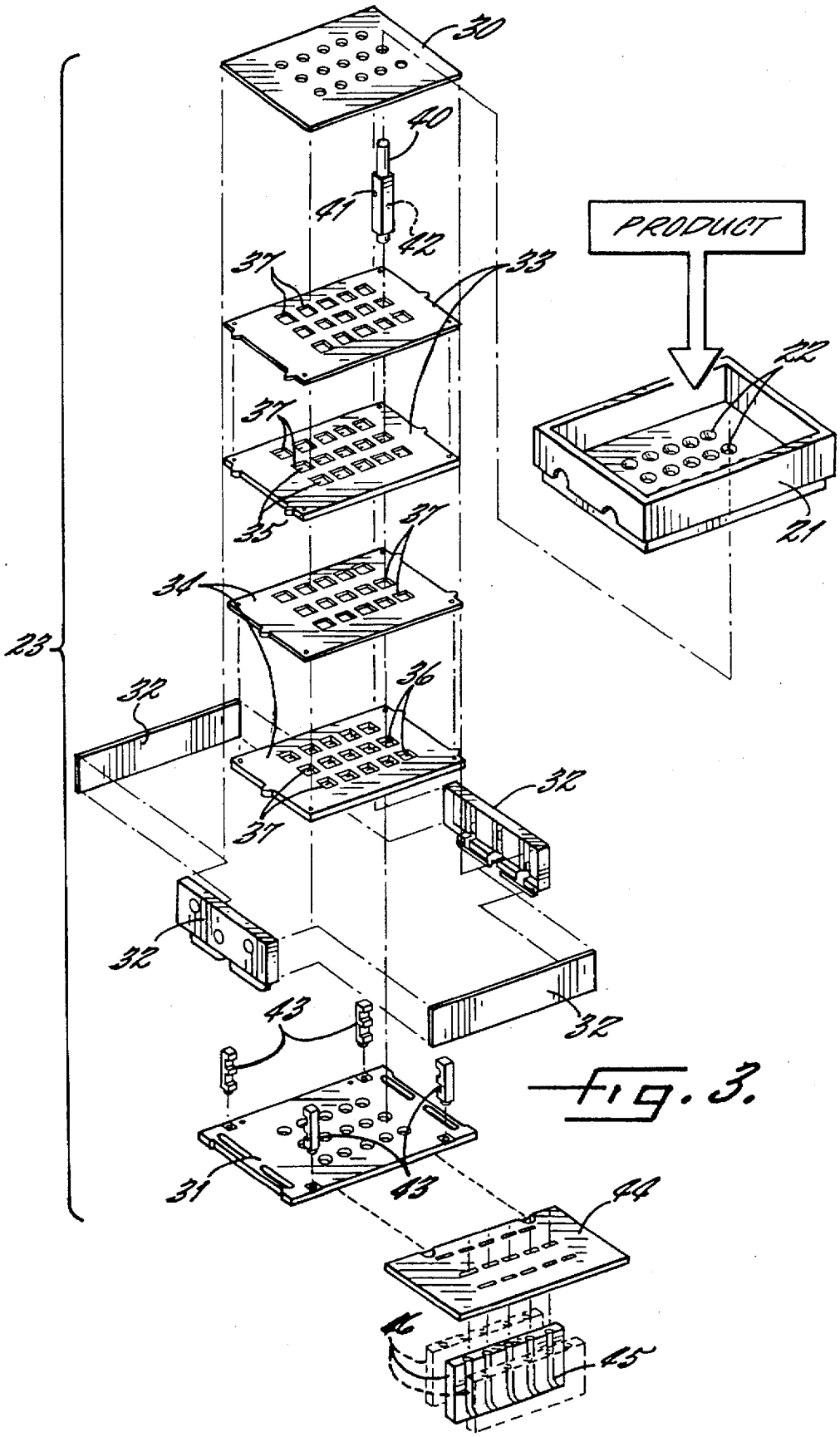
FIG. 3 is a further exploded view of the tray and drop chute assembly illustrating a tube and upper and lower pin plates associated therewith.

The drop chute assembly 23 is shown in a fully exploded configuration in FIG. 3. The drop chute assembly 23 includes a top plate 30 and a bottom plate 31. The drop chute assembly 23 also includes four side plates 32. Contained within the side plates 32 are upper and lower pairs of pin plates 33,34. Each pair of pin plates 33,34 includes upper and lower pins 35,36 extending into openings 37 formed in the pin plates.

A tube 40 extends through each of the respective openings 37 in the upper and lower pin plates 33,34. The tube 40 includes upper and lower openings 41,42 in the sides thereof into which the respective pins 35,36 may be inserted. The pairs of pin plates 33,34 are mounted on four slide posts 43 so that they may be moved back and forth. Accordingly, the pins 35,36 can be alternately moved in and out of the tube 40 so as to form an escapement mechanism allowing only one pill 16 at a time to pass therethrough, as discussed in more detail below. Affixed to the underside of the bottom plate 31 is an attachment plate 44 to which one or more drop chutes 45 are attached.

The drop chutes 45 provide a track down which the pills 16 will travel when they are released by the escapement mechanism. The drop chutes 45 may be uniquely formed to accommodate the different sizes, shapes and types of pills 16 which are to be packaged. Typically, however, the drop chutes 45 include a generally vertical upper portion 49 and an angled lower portion 48. A preferred procedure for manufacturing the drop chutes 45 is milling a single row of chutes into a monolithic block of material, such as nylon, with a CNC machine. Accordingly, the packaging apparatus 10 can be easily changed over to accommodate a different type of pill. Several or more rows 46 may be placed adjacent thereto so as to define a grid of drop chutes 45 having multiple rows and columns.

Figure 5:
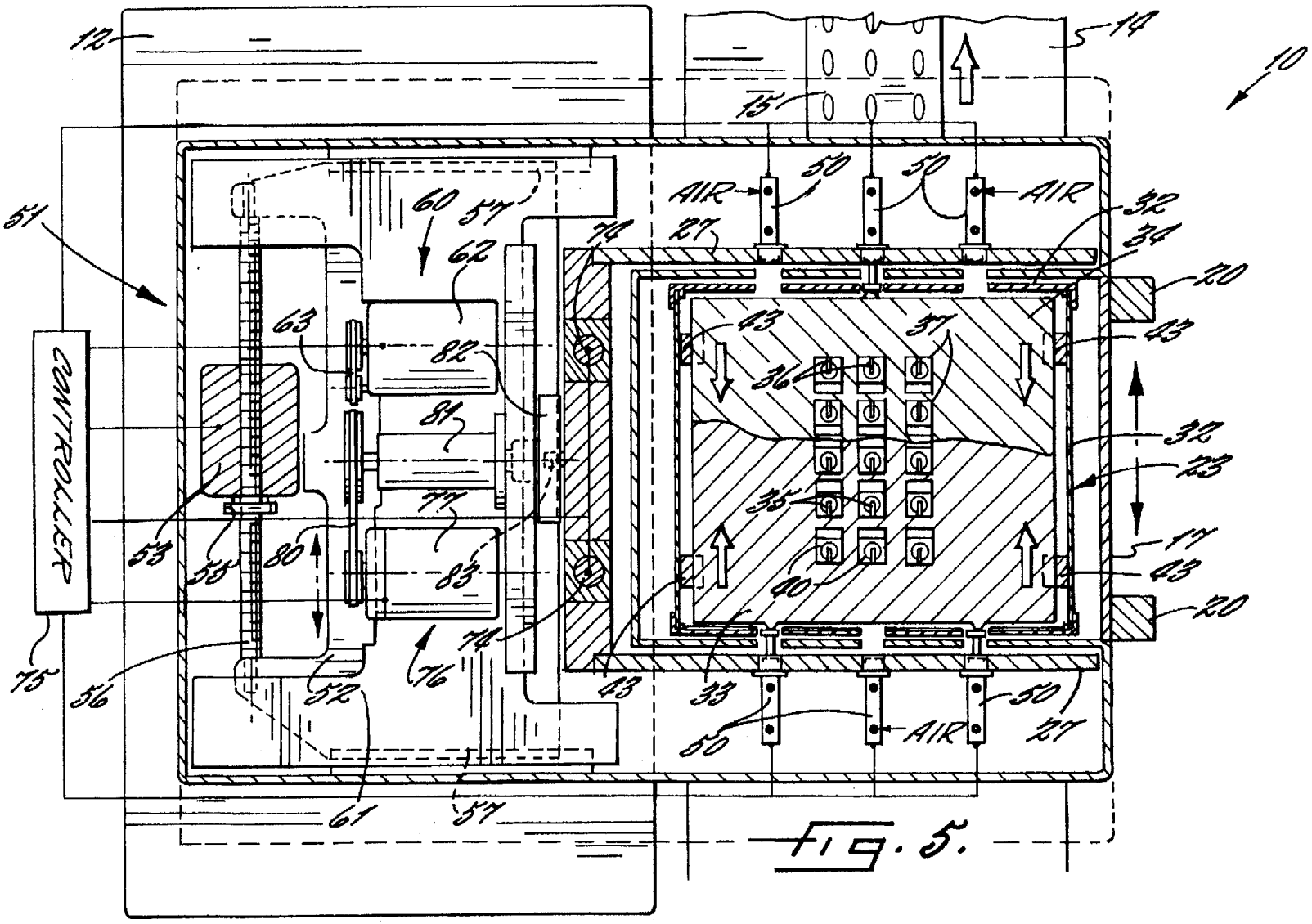
FIG. 5 is a sectional view of the packaging apparatus taken along lines 5—5 of FIG. 4.

FIG. 5 is a sectional top view illustrating two opposed sets of air cylinders 50. The air cylinders 50 act on opposed edges of the upper and lower pin plates 33,34 to move the pins 35,36 in and out of the tubes 40. The air cylinders 50 are connected to a controller 75 which controls and coordinates their actions.

The controller 75 may also be connected to the various other moving parts of the packaging apparatus 10 which are discussed herein so that the operation can be completely automated. As would be understood by one of ordinary skill in the art, the term "controller" as used herein is intended to include any electrical or mechanical device capable of controlling the various components to which it is connected including programmable logic controllers (PLC), computers and their mechanical equivalents. In addition the controller 75 may include a touch screen (not shown) which allows an operator to input various parameters regarding the pills or packages and otherwise control the apparatus.

Figure 4:
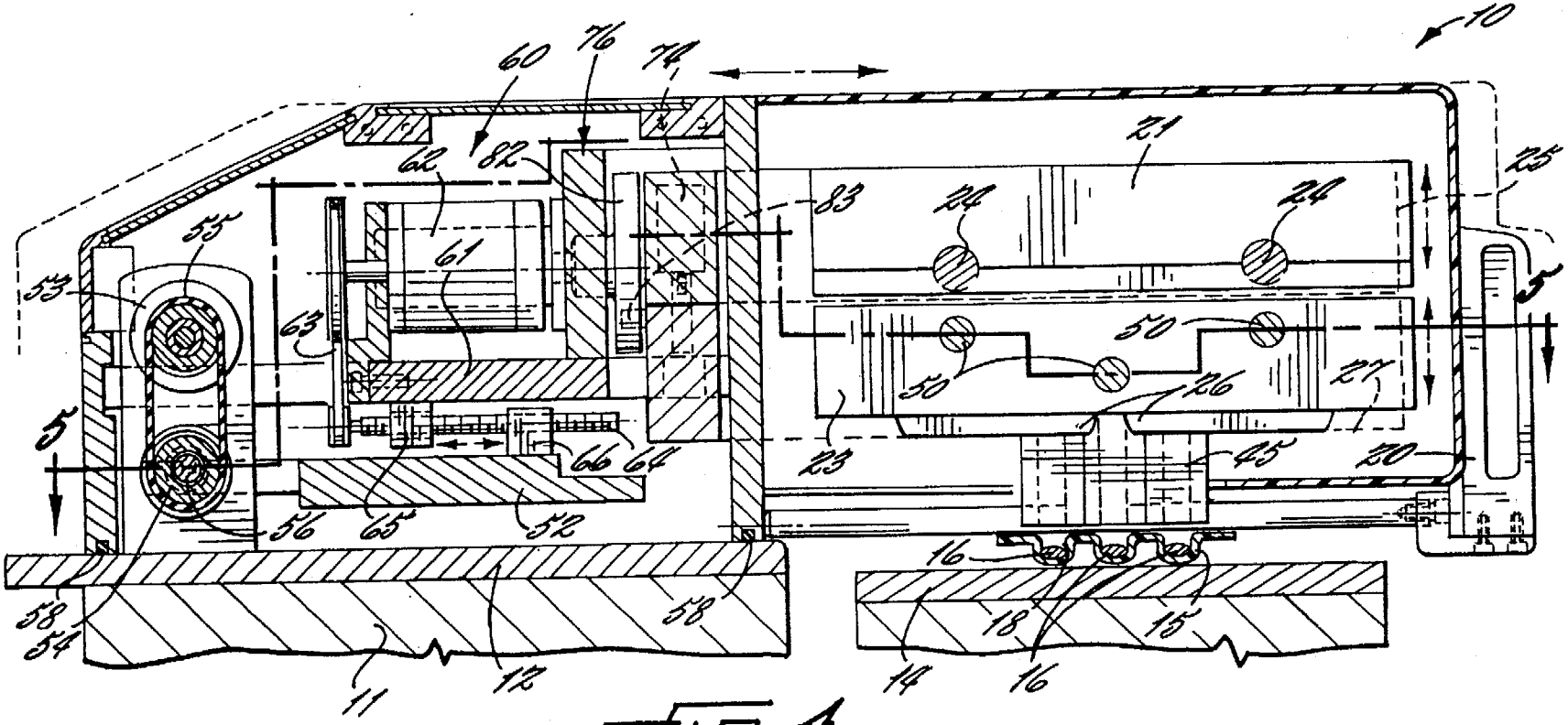
FIG. 4 is a sectional view of a packaging apparatus according to the present invention taken along lines 4—4 of FIG. 1.

Also illustrated in FIG. 5 is a first horizontal positioner 51 for positioning the drop chute assembly 23 along a horizontal direction parallel to the path of travel of the pills. The horizontal positioner 51 includes a lower frame subassembly 52 mounted to the housing 13 on a pair of slides 57. A motor 53 is fixed to the base frame 11 and is operatively connected to a threaded nut 54 by way of a belt 55, as can be seen in FIG. 4. A threaded shaft 56 extends through the threaded nut 54 and is rotatably supported at either end on the lower frame subassembly 52. Alternatively, however, it would be understood by one of ordinary skill in the art that the shaft 56 could be supported on the base frame 11 and the nut 54 supported on the lower frame subassembly 52. Moreover, the motor 53 could drive the shaft 56 to accomplish the same result. The motor 53 may be a servo motor or stepping motor connected to the controller 75.

Thus, as the motor 53 is operated, the threaded nut 54 is rotated which advances the threaded shaft 56 through the nut in a direction which depends upon the direction of rotation of the nut. The lateral movement of the shaft 56 causes the lower frame subassembly 52 to move in the same direction, and the lower frame subassembly 52 is connected to the housing 13 so that the entire packaging apparatus 10 (with the exception of the base frame 11 and motor 53 attached thereto) can be moved back and forth in a direction parallel to the path of travel of the pill receptacles 18.

A second horizontal positioner 60 is illustrated in FIG. 4 for positioning and moving the drop chutes 45 in horizontal directions transverse to the path of travel of the conveyor 14. The second horizontal positioner 60 includes an upper frame subassembly 61 which is rigidly mounted to the housing 13. Mounted on the upper frame subassembly 61 is a motor 62 which is operatively connected by way of a belt 63 to a threaded shaft 64. The motor 62 may be a servo motor or stepping motor connected to the controller 75. The threaded shaft 64 is attached to the upper frame subassembly 61 by a bearing block 65 and also extends through a threaded nut 66 which is fixed to the lower frame subassembly 52. Alternatively, however, it would be apparent to one of ordinary skill in the art that the threaded nut 66 could be connected to the upper frame subassembly 61 and the motor 62 and bearing block 65 connected to the lower frame subassembly 52. Moreover, the threaded nut 66 could be driven by the motor 62.

The lower frame subassembly 52 is supported on the housing 13 on the pair of slides 57. Accordingly, as the motor 62 is operated, the threaded shaft 64 is advanced through the threaded nut 66 so that the upper frame subassembly 61 moves in a horizontal direction relative to the lower frame subassembly 52. Thus, because the upper frame subassembly 61 is attached to the housing 13, the entire packaging apparatus 10 (with the exception of the motor 53 attached to the base frame 11 and the lower frame assembly 52 connected to the threaded shaft 56) moves in a horizontal direction transverse to the path of travel of the pill receptacles 18.

A seal 58 extends around the lower periphery of the housing 13 and is in sliding contact with the base plate 12. Accordingly, as the housing 13 moves in the horizontal directions, the housing 13 remains sealed to the base plate 12 to prevent possible contamination, which can be very important in the pharmaceutical industry. The seal 58 is preferably formed of a durable material such as nylon.

Also illustrated in FIG. 4 is the pair of lower arms 27 which are attached to the upper frame subassembly 61. The lower arms 27 include the rails 26 for supporting the drop chute assembly 23 and the air cylinders 50 for activating the escapement mechanism of the drop chute assembly. Mounted on top of the lower arms 27 are a pair of upper arms 25 which include the lugs 24 for supporting the tray 21.

A first pair of actuators 74 are mounted between the upper and lower arms 25,27 for reciprocally raising and lowering the upper arms relative to the lower arms. The reciprocal up and down motion of the tray 21 prevents pills 16 from blocking the openings 22 in the tray. The actuators 74 are preferably air cylinders which are connected to the controller 75. The controller 75 can vary the vertical velocity or acceleration rates of the tray 21, which is highly preferred over reciprocal motions having velocity and acceleration profiles which are functions of the vertical position of the tray, such as those generated by a cam. In particular, the variable velocity and acceleration rates can ensure that the pills 16 do not form blockages over the openings 22. The first actuators 74 preferably have a stroke of about 18 mm and operate at an average frequency of about 6 Hz.

Figure 17:
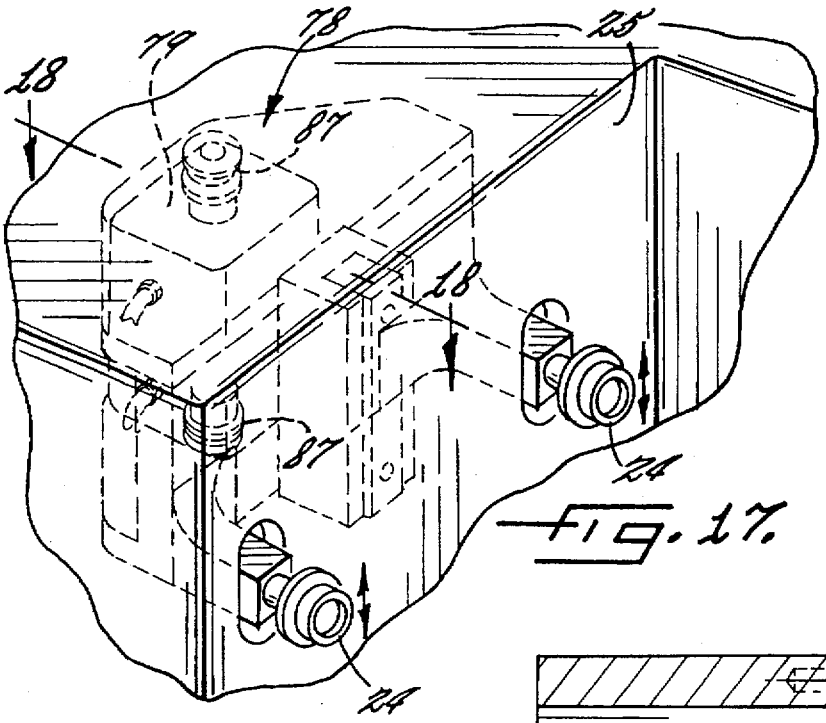
FIG. 17 is a partially sectioned and enlarged view of an actuator for reciprocally raising and lowering the tray (shown in FIGS. 2 and 3) for supporting an accumulation of pills.
Figure 18:
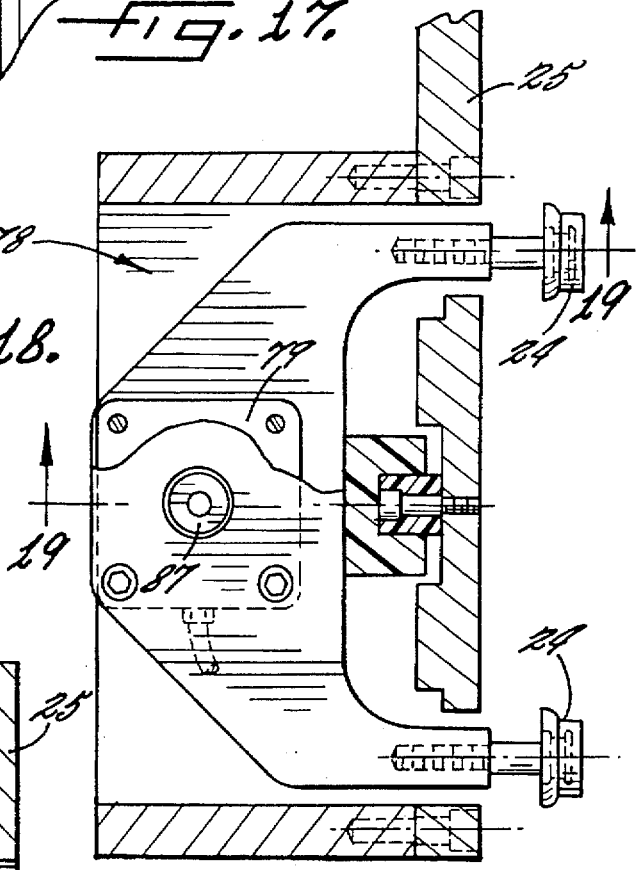
FIG. 18 is a sectional view of the actuator taken along lines 18—18 of FIG. 17.
Figure 19:
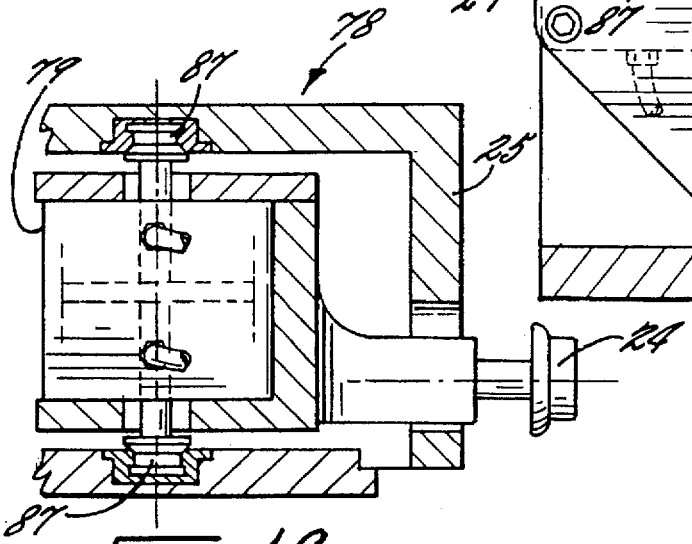
FIG. 19 is a sectional view of the actuator taken along lines 19—19 of FIG. 18.

In some instances, the first pair of actuators 74 may not be sufficient to prevent all blockages from occurring. Accordingly, a second pair of actuators 78 is provided on the upper arms 25 which add a second layer of vertical motion to the tray 21. As shown in FIGS. 17–19, each of the second actuators 78 includes an air cylinder 79 having opposed piston ends 87 fixedly mounted within a respective upper arm 25.

Attached to the body of the cylinder 79 are the lugs 24 for supporting the tray 21. The air cylinder 79 preferably has a total stroke of about 5 mm and reciprocates at average frequencies which are generally higher than the frequency of the first actuators 74.

The tray 21 can thus be moved up or down in response to the movements of both the first 74 and second 78 actuators. The vertical displacement, speed and acceleration of the tray 21 can be varied between the operation of the first 74 and second 78 actuators. For example, a high frequency, short stroke motion can be provided by the second actuator 78, which is generally preferable for small, uncoated pills, and a lower frequency, longer stroke motion can be provided by the first actuator 74, which is generally preferable for larger, coated pills having a smooth surface, such as caplets.

It is to be understood, however, that the controller 75 can greatly vary the displacement, velocity and acceleration profiles of the tray 21 by determining the amount and allocation of pressurized air sent to the individual actuators 74,78. Conventional systems which vertically reciprocate a tray with one rotating motor and a cam mechanism can only cause a vertical velocity and acceleration which is a direct mathematical function of the vertical position of the tray. This generates a purely cyclical motion which may not adequately ensure that pill blockages do not occur. In contrast, the velocity and acceleration rates of the tray 21 of the present invention are independent of the vertical position of the tray and pill blockages are advantageously eliminated.

Figure 12:
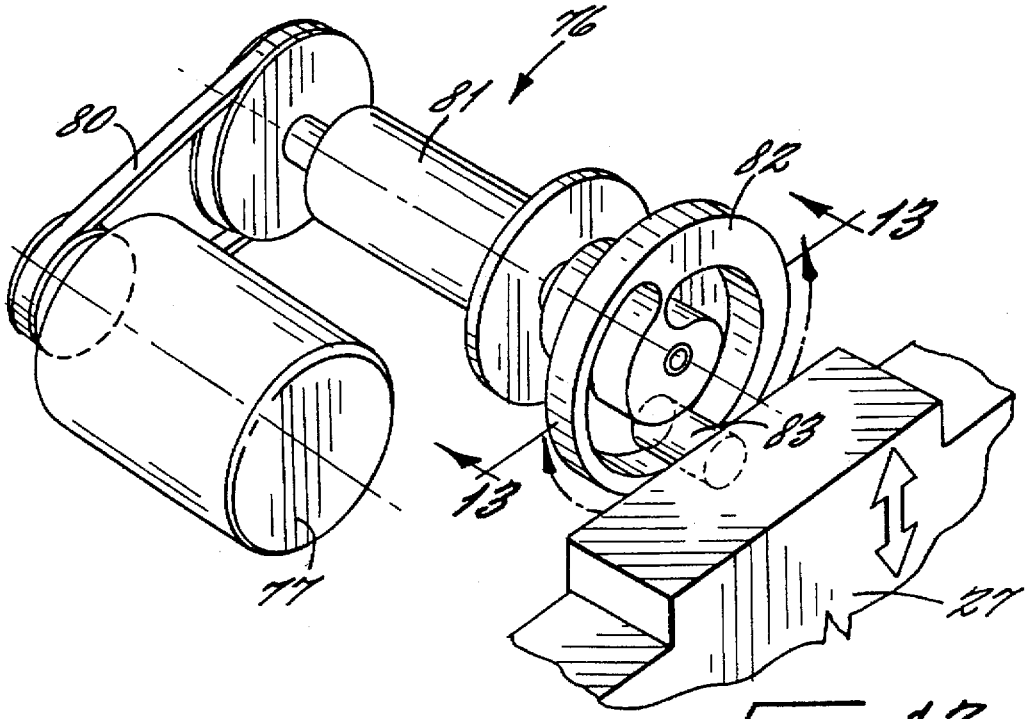
FIG. 12 is a cutaway perspective view of a vertical positioner for positioning the drop chute assembly.
Figure 13:
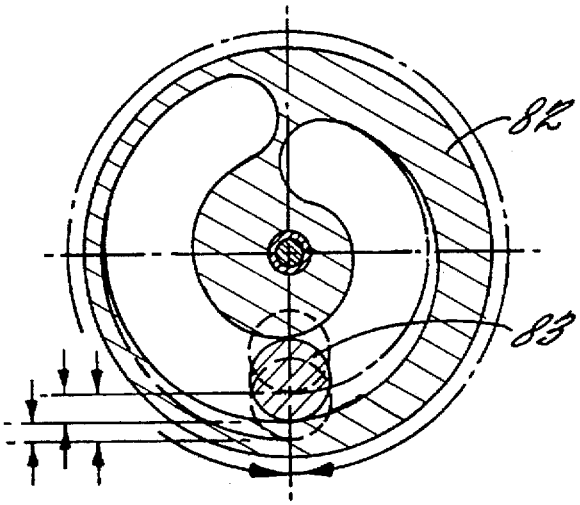
FIG. 13 is a sectional view of an eccentric cam of the vertical positioner taken along lines 13—13 of FIG. 12.

A vertical positioner 76 is illustrated in FIGS. 12 and 13. The vertical positioner 76 vertically positions the drop chute assembly 23 so that the lower ends of the drop chutes 45 can be moved adjacent to the conveyor 14. The vertical positioner 76 includes a motor 77 which is mounted on the upper frame assembly 61 and which is operatively connected by way of a belt 80 to a spindle 81. The motor is also preferably a servo motor or stepping motor connected to the controller 75. At the opposite end of the spindle 81 is an eccentric cam 82, and attached to the lower arms 27 is a cam follower 83 which extends horizontally into the eccentric cam 82. Accordingly, as the motor 77 is operated, the eccentric cam 82 is rotated which causes the cam follower 83 to be raised or lowered, as can be seen in FIG. 13. This causes the lower arms 27 to be raised or lowered which in turn causes the lower ends of the drop chutes 45 to be raised or lowered relative to the conveyor 14.

Figure 6:
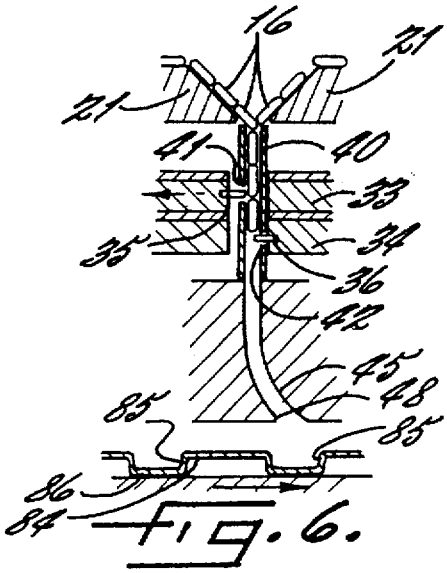
FIGS. 6—11 are partial sectional views of the drop chute assembly illustrating a sequence of movements for placing a pill into a pill receptacle.
Figure 7:
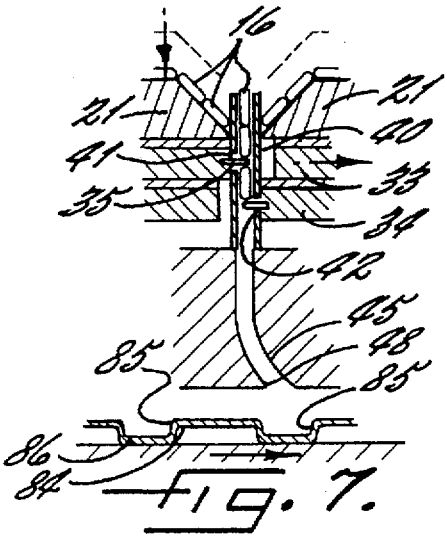

The advantageous operation of the present invention will now be described in connection with FIGS. 6–11 and 14–16. In each of these figures, the pills 16 are being placed into pill receptacles 18 which are illustrated as blisters in a blister package 15. In FIG. 6, the drop chute 45 and tray 21 are both shown in raised positions. The tube 40 is filled with pills 16 and the lower pin 36 is positioned within the tube. In FIG. 7, the upper pin 33 has been moved into the tube and the tray 21 has been moved downward. As discussed above, however, the motion of the tray 21 is independent of the operation of the vertical positioner 76 and the vertical position of the drop chute 45.

Figure 8:
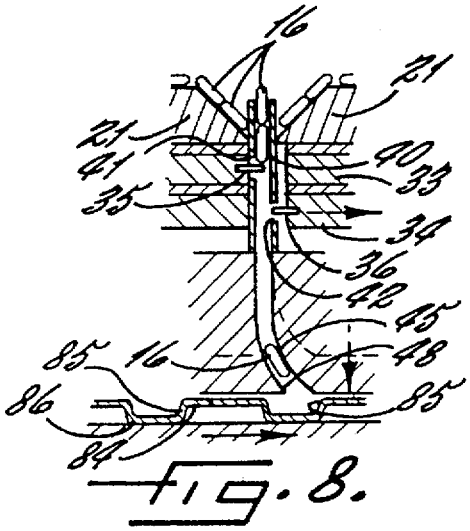
Figure 9:
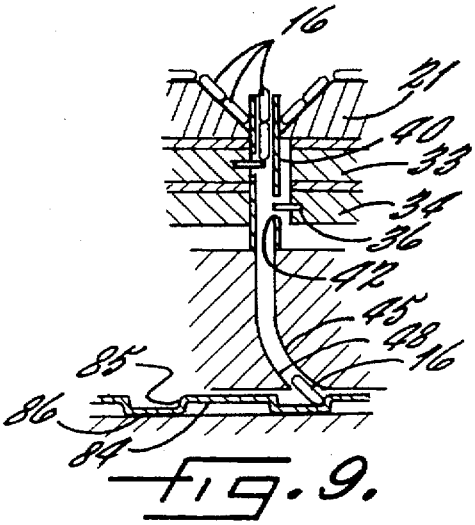

In FIG. 8, the lower pin 36 has been removed from the tube 40 and a pill 16 has been released to fall through the drop chute 45. In addition, the drop chute 45 has been lowered to be adjacent to the pill receptacle 18. The instantaneous horizontal position of the pill receptacle 18 (which may move intermittently or continuously on the conveyor 14) is fed to the controller 75 by way of a sensor (not shown), such as a laser eye in registration with the leading edge of the receptacle, so that the horizontal position of the drop chute 45 can be coordinated with respect to the position of the pill receptacle.

Blister packages 15 typically include a generally planar web portion 84 and have receptacles 18 which are defined in part by a circumferential sidewall 85 extending below the web portion. A bottom wall 86 is connected to the lower end of the sidewall 85. Because of the positionability of the drop chute 45, the pill 16 may be advantageously released so that the leading edge of the pill contacts the sidewall 85 of the receptacle 18, which provides a positive stop for the motion of the pill from the end of the chute.

Figure 10:
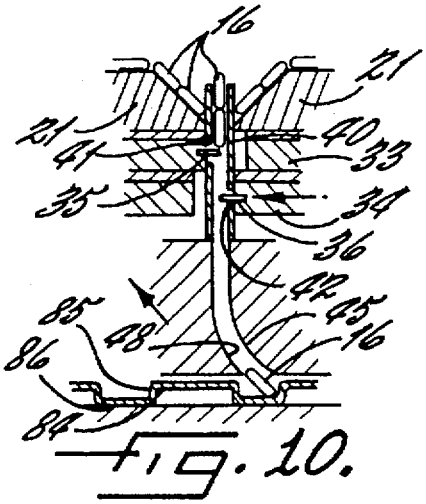
Figure 11:
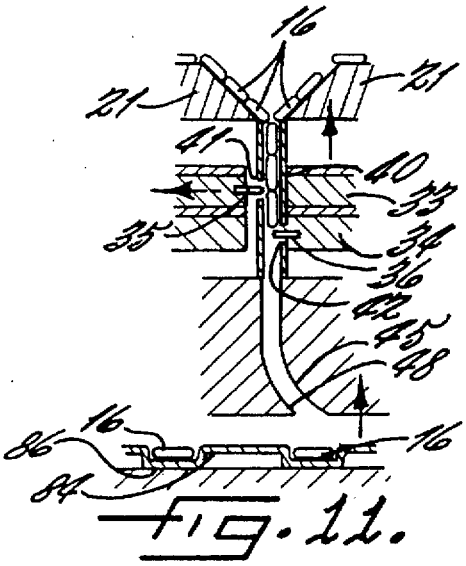

The drop chute 45 is then raised away from the pill receptacle 18 as illustrated in FIGS. 10 and 11. With conventional packaging apparatus of the type discussed above, however, the drop chute 45 is horizontally fixed or moves at the same speed as the pill receptacles 18. Accordingly, the lower portion 48 of the drop chute 45 cannot be moved horizontally relative to the pill receptacle 18 while the pill 16 is being placed in the receptacle. This can create problems if the angle of the lower end 48 of the drop chute 45 is too shallow or if the pill 16 has an overly elongated profile because the lower end of the drop chute may engage the trailing end of the pill and stand the pill up on its leading edge when the drop chute is vertically withdrawn.

One advantage accorded by the present invention is the step illustrated in FIG. 10 wherein the drop chute 45 is moved away from the pill 16 both horizontally and vertically so as to ensure that the lower end 48 of the drop chute 45 is completely disengaged from the pill. Specifically, both the horizontal positioner 51 and the vertical positioner 76 are operated simultaneously so that the lower end 48 of the drop chute 45 moves away at an angle from the pill receptacle 18, as denoted by the arrow in FIG. 10. After the pill 16 has been disengaged, the drop chute 45 may thereafter be raised in a purely vertical direction as shown in FIG. 11. The drop chute 45 is then moved horizontally to fill the next empty receptacle, and can be made to "gallop" with successive pill receptacles.

The further operation of the escapement mechanism can also be seen in FIGS. 10 and 11. The lower pin 36 is first inserted in the tube 40 and then the upper pin 35 is withdrawn so that the pills advance adjacent to the lower pin.

Figure 14:
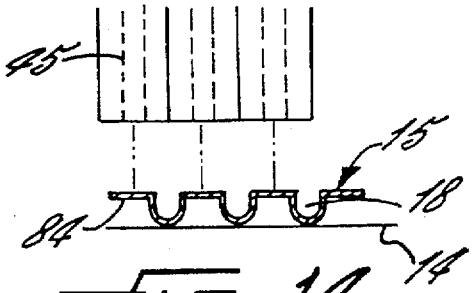
FIGS. 14–16 are rear sectional views of the drop chute assembly illustrating a sequence of movements for placing pills into pill receptacles.
Figure 15:
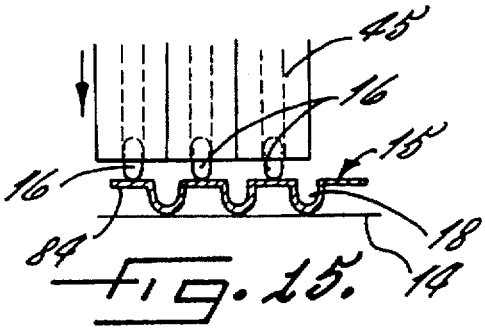
Figure 16:
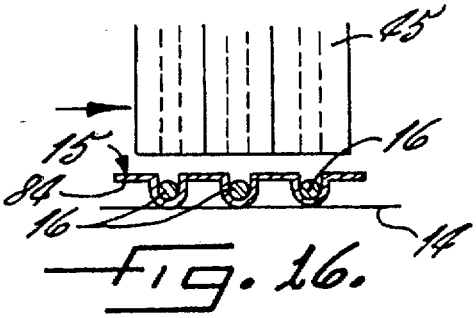

Another advantageous method of placing pills with the apparatus according to the present invention is illustrated in FIGS. 14–16, which are viewed from the same position as FIG. 4. In FIG. 14, the drop chutes 45 are shown in an initial raised position. In FIG. 15, the drop chutes 45 are lowered and the pills 16 are released to fall through the chutes and come into engagement with the web portion 84 of the packages 15. The second horizontal positioner 60 is then activated to move the drop chutes 45 in a direction transverse to the path of travel of the pill receptacles 15 so that the pills 16 slide across the web portion 84 and fall into the pill receptacles 18. This procedure may be advantageous for various pill, pill receptacle and drop chute geometries.

The first and second horizontal positioners 51,60 according to the present invention thus advantageously provide a packaging apparatus 10 which can precisely and quickly place pills 16 into pill receptacles 18. Although two preferred methods of using the horizontal positioners 51,60 are discussed above in connection with FIGS. 6–11 and 14–16, it will be understood that there are myriad other possible ways of placing the pills 16 into the pill receptacles 18. Various combinations of horizontal and vertical movements may be coordinated by the controller 75, it being understood that two or three of the positioners could be operated simultaneously with the capability of moving the drop chutes 45 at various angles and speeds relative to the package 15. As a result, various pill geometries or characteristics, such as surface stickiness in the case of gel tablets, can be accommodated without the need for radically changing the drop chute geometries. Thus, the present invention meets the needs which were not met by the prior art and provides a highly improved and advantageous packaging apparatus.

The invention has been described in considerable detail with reference to preferred embodiments. However, many changes, variations, and modifications can be made without departing from the spirit and scope of the invention as described in the foregoing specification and found in the appended claims.

That which is claimed is:

1. A packaging apparatus for placing pills into a series of pill receptacles, said apparatus comprising:

a base frame;

a conveyor for conveying a series of pill receptacles adjacent to said base frame, said conveyor moving said pill receptacles at a predetermined speed along a predetermined path of travel;

at least one drop chute extending over said conveyor, said drop chute having an upper end for receiving pills which are to be packaged and a lower end from which pills are sequentially placed into the pill receptacles;

a vertical positioner operatively connected to said base frame and said drop chute for vertically positioning said drop chute and for moving said lower end of said drop chute adjacent to the pill receptacles; and a horizontal positioner operatively connected to said base frame and said drop chute for positioning said drop chute relative to said base frame along a horizontal direction parallel to the predetermined path of travel of the pill receptacles and for moving said drop chute in said direction at a speed independent of the speed of the pill receptacles moving on said conveyor.

2. A packaging apparatus as defined in claim 1 further comprising a frame subassembly slidably mounted on said base frame for movement in a horizontal direction parallel to the path of travel and supporting said drop chute, wherein said horizontal positioner further comprises a motor, a threaded nut driven by said motor and a threaded shaft extending through said nut, and wherein one of said nut and said shaft is connected to said base frame and the other is connected to said frame subassembly.

3. A packaging apparatus as defined in claim 1 further comprising a pair of arms for supporting said drop chute, said arms being slidably connected to said base frame for movement in a vertical direction, and wherein said vertical positioner further comprises a motor operatively connected to said base frame, an eccentric cam attached to said motor and a cam follower extending horizontally from said arms and engaging said cam.

4. A packaging apparatus as defined in claim 1 further comprising an escapement mechanism for sequentially dropping one pill at a time into said upper end of said drop chute, said escapement mechanism comprising a tube vertically adjacent to said drop chute, an upper pin adjacent the upper end of said tube and a lower pin adjacent the lower end of said tube, wherein said pins are alternately movable in and out of said tube.

5. A packaging apparatus as defined in claim 1 further comprising a plurality of drop chutes extending in substantially parallel directions, each of said lower ends of said drop chutes being arranged in a grid so that a plurality of pills are placed simultaneously into a plurality of pill receptacles.

6. A packaging apparatus as defined in claim 1 wherein said conveyor has an intermittent operation and is capable of repeatedly stopping and starting to move the pill receptacles at the predetermined speed.

7. A packaging apparatus as defined in claim 1 wherein said conveyor has a continuous operation.

8. A packaging apparatus for placing pills into a series of pill receptacles moving at a predetermined speed along a predetermined path of travel, said apparatus comprising:

a base frame;

at least one drop chute extending over the predetermined path of travel, said drop chute having an upper end for receiving pills which are to be packaged and a lower end from which pills are sequentially placed into the pill receptacles;

a vertical positioner operatively connected to said base frame and said drop chute for vertically positioning said drop chute and for moving said lower end of said drop chute adjacent to the pill receptacles;

a controllable horizontal positioner operatively connected to said base frame and said drop chute for positioning said drop chute relative to said base frame along a horizontal direction parallel to the predetermined path of travel of the pill receptacles and for moving said lower end of said drop chute in said direction at a speed independent of the speed of the pill receptacles;

a controller for controlling said horizontal positioner in response to the speed and position of the pill receptacles so that the lower end of the drop chute can be moved horizontally with respect to a pill receptacle while a pill is being placed therein; and a pair of arms for supporting said drop chute, said arms being slidably connected to said base frame for movement in a vertical direction, and wherein said vertical positioner further comprises a motor operatively connected to said base frame, an eccentric cam attached to said motor and a cam follower extending horizontally from said arms and engaging said cam.

9. A packaging apparatus for placing pills into a series of pill receptacles moving at a predetermined speed along a predetermined path of travel, said apparatus comprising:

a base frame;

at least one drop chute extending over the predetermined path of travel, said drop chute having an upper end for receiving pills which are to be packaged and a lower end from which pills are sequentially placed into the pill receptacles;

a vertical positioner operatively connected to said base frame and said drop chute for vertically positioning said drop chute and for moving said lower end of said drop chute adjacent to the pill receptacles;

a controllable horizontal positioner operatively connected to said base frame and said drop chute for positioning said drop chute relative to said base frame along a horizontal direction parallel to the predetermined path of travel of the pill receptacles and for moving said lower end of said drop chute in said direction at a speed independent of the speed of the pill receptacles;

a controller for controlling said horizontal positoner in response to the speed and position of the pill receptacles so that the lower end of the drop chute can be moved horizontally with respect to a a pill receptacle while a pill is being placed therein; and a frame subassembly slidably mounted on said base frame for movement in a horizontal direction parallel to the path of travel and supporting said drop chute, wherein said horizontal positioner further comprises a motor, a threaded nut driven by said motor and a threaded shaft extending through said nut, and wherein one of said nut and said shaft is connected to said base frame and the other is connected to said frame subassembly.

10. A packaging apparatus for placing pills into a series of pill receptacles continuously moving at a predetermined speed along a predetermined path of travel, said apparatus comprising:

a base frame;

at least one drop chute extending over the predetermined path of travel, said drop chute having an upper end for receiving pills which are to be packaged and a lower end from which pills are sequentially placed into the pill receptacles;

a vertical positioner operatively connected to said base frame and said drop chute for vertically positioning said drop chute and for moving said lower end of said drop chute adjacent to the pill receptacles;

a controllable horizontal positioner operatively connected to said base frame and said drop chute for positioning said drop chute relative to said base frame along a horizontal direction parallel to the predetermined path of travel of the pill receptacles and for moving said lower end of said drop chute in said direction at a speed independent of the speed of the pill receptacles; and a controller for controlling said horizontal positioner in response to the speed and position of the pill receptacles so that the lower end of the drop chute can be moved horizontally with respect to a pill receptacle while a pill is being placed therein.

11. A packaging apparatus as defined in claim 8 further comprising an escapement mechanism for sequentially dropping one pill at a time into said upper end of said drop chute, said escapement mechanism comprising a tube vertically adjacent to said drop chute, an upper pin adjacent the upper end of said tube and a lower pin adjacent the lower end of said tube, wherein said pins are alternately movable in and out of said tube.

12. A packaging apparatus as defined in claim 8 further comprising a plurality of drop chutes extending in substantially parallel directions, each of said lower ends of said drop chutes being arranged in a grid so that a plurality of pills are placed simultaneously into a plurality of pill receptacles.

13. A packaging apparatus for placing pills into a series of pill receptacles moving at a predetermined speed along a predetermined path of travel, said apparatus comprising:

a base frame;

at least one drop chute extending over the predetermined path of travel, said drop chute having an upper end for receiving pills which are to be packaged and a lower end from which pills are sequentially placed into the pill receptacles;

a vertical positioner operatively connected to said base frame and said drop chute for vertically positioning said drop chute and for moving said lower end of said drop chute adjacent to the pill receptacles;

a controllable horizontal positioner operatively connected to said base frame and said drop chute for positioning said drop chute relative to said base frame along a horizontal direction parallel to the predetermined path of travel of the pill receptacles and for moving said lower end of said drop chute in said direction at a speed independent of the speed of the receptacles;

a controller for controlling said horizontal positioner in response to the speed and position of the pill receptacles so that the lower end of the drop chute can be moved horizontally with respect to a pill receptacle while a pill is being placed therein; and wherein said vertical positioner is controllable and said controller controls said vertical positioner in response the speed and position of the pill receptacles.

14. A packaging apparatus for placing pills into a series of pill receptacles moving at a predetermined speed along a predetermined path of travel, said apparatus comprising:

a base frame;

at least one drop chute extending over the predetermined path of travel, said drop chute having an upper end for receiving pills which are to be packaged and a lower end from which pills are sequentially placed into the pill receptacles;

a vertical positioner operatively connected to said base frame and said drop chute for vertically positioning said drop chute and for moving said lower end of said drop chute adjacent to the pill receptacles; and a horizontal positioner operatively connected to said base frame and said drop chute for positioning and moving said drop chute in horizontal directions transverse to the predetermined path of travel of the pill receptacles.

15. A packaging apparatus as defined in claim 14 further comprising a frame subassembly slidably mounted on said base frame for movement in a horizontal direction transverse to the path of travel and supporting said drop chute, wherein said horizontal positioner further comprises a motor, a threaded nut and a threaded shaft extending through said nut and driven by said motor, and wherein one of said nut and said shaft is connected to said base frame and the other is connected to said frame subassembly.

16. A packaging apparatus as defined in claim 14 further comprising a pair of arms for supporting said drop chute, said arms being slidably connected to said base frame for movement in a vertical direction, and wherein said vertical positioner further comprises a motor operatively connected to said base frame, an eccentric cam attached to said motor and a cam follower extending horizontally from said arms and engaging said cam.

17. A packaging apparatus as defined in claim 14 further comprising an escapement mechanism for sequentially dropping one pill at a time into said upper end of said drop chute, said escapement mechanism comprising a tube vertically adjacent to said drop chute, an upper pin adjacent the upper end of said tube and a lower pin adjacent the lower end of said tube, wherein said pins are alternately movable in and out of said tube.

18. A packaging apparatus as defined in claim 14 further comprising a plurality of drop chutes extending in substantially parallel directions, each of said lower ends of said drop chutes being arranged in a grid so that a plurality of pills are placed simultaneously into a plurality of pill receptacles.

19. A packaging apparatus for placing pills into a series of pill receptacles moving at a predetermined speed along a predetermined path of travel, said apparatus comprising:

a base frame;

at least one drop chute extending over the predetermined path of travel, said drop chute having an upper end for receiving pills which are to be packaged and a lower end from which pills are sequentially placed into the pill receptacles;

a vertical positioner operatively connected to said base frame and said drop chute for vertically positioning said drop chute and for moving said lower end of said drop chute adjacent to the pill receptacles;

a first horizontal positioner operatively connected to said base frame and said drop chute for positioning said drop chute relative to said base frame along a horizontal direction parallel to the predetermined path of travel of the pill receptacles and for moving said drop chute in said direction at a speed independent of the speed of the pill packages; and a second horizontal positioner operatively connected to said base frame and said drop chute for positioning and moving said drop chute in horizontal directions transverse to the predetermined path of travel of the pill receptacles.

20. A packaging apparatus as defined in claim 19 further comprising:

a lower frame subassembly slidably mounted on said base frame for movement in a horizontal direction parallel to the path of travel, wherein said first horizontal positioner further comprises a motor, a threaded nut driven by said motor and a threaded shaft extending through said nut, and wherein one of said nut and said shaft is connected to said base frame and the other is connected to said lower frame subassembly; and an upper frame subassembly slidably connected to said lower frame subassembly for movement in a horizontal direction transverse to the path of travel and supporting said drop chute, wherein said second horizontal positioner further comprises a motor, a threaded nut and a threaded shaft extending through said nut and driven by said motor, and wherein one of said nut and said shaft is connected to said lower frame subassembly and the other is connected to said upper frame subassembly.

21. A packaging apparatus as defined in claim 19 further comprising a pair of arms for supporting said drop chute, said arms being slidably connected to said base frame for movement in a vertical direction, and wherein said vertical positioner further comprises a motor operatively connected to said base frame, an eccentric cam attached to said motor and a cam follower extending horizontally from said arms and engaging said cam.

22. A packaging apparatus as defined in claim 19 further comprising an escapement mechanism for sequentially dropping one pill at a time into said upper end of said drop chute, said escapement mechanism comprising a tube vertically adjacent to said drop chute, an upper pin adjacent the upper end of said tube and a lower pin adjacent the lower end of said tube, wherein said pins are alternately movable in and out of said tube.

23. A packaging apparatus as defined in claim 19 further comprising a plurality of drop chutes extending in substantially parallel directions, each of said lower ends of said drop chutes being arranged in a grid so that a plurality of pills are placed simultaneously into a plurality of pill receptacles.

24. A packaging apparatus for passing a series of pills into at least one drop chute for placement of the pills into pill receptacles, said apparatus comprising:

a tray for supporting an accumulation of pills over the drop chute, said tray defining at least one opening in a lower portion thereof aligned with the drop chute;

at least one controllable actuator operatively connected to said tray for reciprocally raising and lowering said tray relative to the drop chute and causing the pills to fall sequentially through the opening in said tray; and a controller connected to said actuator and being capable of providing the reciprocating movement of said tray by said actuator at a rate independent of the vertical position of said tray to prevent pills in said tray from forming blockages over the opening in said tray.

25. A packaging apparatus as defined in claim 24 further comprising first and second controllable actuators for reciprocally raising and lowering said tray relative to the drop chute, said actuators being independently controlled by said controller.

26. A packaging apparatus as defined in claim 25 further comprising a frame supporting the drop chute, a pair of vertically movable arms supported on said frame, and at least one support member on each of said arms for supporting said tray, wherein said first actuator moves said arms relative to said frame and said second actuator moves said support members relative to said arms.

27. A packaging apparatus as defined in claim 24 further comprising a tube having an upper end and a lower end aligned with the drop chute, said upper end extending through the opening in said tray when said tray is in a lowered position and being adjacent to the opening when said tray is in a raised position.

28. A packaging apparatus as defined in claim 27 wherein said tube defines upper and lower openings adjacent the ends thereof, and further comprising an escapement mechanism for sequentially dropping one pill at a time into said upper end of said drop chute, said escapement mechanism comprising an upper pin movable in and out of the upper opening of said tube and a lower pin alternately movable in and out of the lower end of said tube.

29. A packaging apparatus as defined in claim 28 wherein said upper and lower pins are moved by controllable actuators and wherein said actuators are operably connected to said controller.

30. A packaging apparatus as defined in claim 25 wherein said first and second actuators further each comprise at least one air cylinder.

31. A method of placing pills into a series of pill receptacles continuously moving at a predetermined speed along a predetermined path of travel, said method comprising the steps of:

arranging a plurality of pills above an upper end of at least one drop chute;

positioning the drop chute so that the lower end thereof is adjacent to the pill receptacles;

releasing one of the pills to drop through the drop chute; and moving the drop chute in a horizontal direction parallel to the path of travel of the pills and at a speed independent of the speed of the pill receptacles so that the lower end of the drop chute is moved horizontally with respect to a pill receptacle while a pill is being placed therein.

32. A method of placing pills as defined in claim 31 wherein said drop chute moving step further comprises moving the drop chute in a horizontal direction opposite to the moving direction of the pill receptacles.

33. A method of placing pills as defined in claim 32 wherein said drop chute moving step further comprises raising the drop chute while moving the drop chute in the horizontal direction.

34. A method of placing pills into a series of pill packages having a generally planar web portion and defining a plurality of pill receptacles formed below the web portion, said method comprising the steps of:

arranging a plurality of pills above an upper end of at least one drop chute;

positioning the drop chute so that the lower end thereof is adjacent the web portion;

releasing one of the pills to drop through the drop chute and contact the web portion so that one portion of the pill is engaged by the lower end of the drop chute and an opposite portion of the pill is engaged by the web portion; and moving the drop chute in a horizontal direction with respect to the pill packages so that the pill falls into a respective pill receptacle and is disengaged from the lower end of the drop chute.

35. A method of placing pills as defined in claim 34 wherein said drop chute moving step further comprises raising the drop chute while moving the drop chute in the horizontal direction.

36. A method of placing pills into a plurality of pill receptacles, each of the receptacles having a circumferential sidewall and a bottom wall connected to the lower end of the sidewall, said method comprising the steps of:

arranging a plurality of pills above an upper end of at least one drop chute;

lowering the drop chute so that the lower end thereof is adjacent to the sidewall of the receptacle;

releasing one of the pills to drop through the drop chute and contact the sidewall so that the pill is engaged between the lower end of chute and the sidewall; and moving the drop chute in a horizontal direction away from the sidewall so that the pill is disengaged from the lower end of the drop chute and is supported on the bottom wall of the receptacle.

37. A method of placing pills as defined in claim 36 wherein said drop chute moving step further comprises raising the drop chute while moving it horizontally away from the sidewall.

* * * * *

UNITED STATES PATENT AND TRADEMARK OFFICE

CERTIFICATE OF CORRECTION

PATENT NO. : 5,737,902

DATED : April 14, 1998

INVENTOR(S) : Aylward

It is certified that error appears in the above-identified patent and that said Letters Patent is hereby corrected as shown below:

Column 13, line 11, delete "a", second occurrence; line 48, "claim 8" should be --claim 10--; line 56, "claim 8" should be --claim 10--.

Column 14, line 13 before receptacles, insert --pill--; line 20, after response, insert --to--.

Column 18, line 13, before chute, insert --the drop--.

Signed and Sealed this

Eighth Day of December, 1998

Bruce Lehman

*Attest:*

BRUCE LEHMAN

*Attesting Officer*

*Commissioner of Patents and Trademarks*